US009044122B2

(12) United States Patent
Corbell et al.

(10) Patent No.: US 9,044,122 B2
(45) Date of Patent: Jun. 2, 2015

(54) ACTUATOR

(76) Inventors: Michael Corbell, Trinity Beach (AU); Kymmie Corbell, Trinity Beach (AU)

( * ) Notice: Subject to any disclaimer, the term of this patent is extended or adjusted under 35 U.S.C. 154(b) by 477 days.

(21) Appl. No.: 13/135,906

(22) Filed: Jul. 18, 2011

(65) Prior Publication Data

US 2011/0277228 A1 Nov. 17, 2011

Related U.S. Application Data

(63) Continuation of application No. PCT/AU2010/000556, filed on May 18, 2010.

(51) Int. Cl.
*A47K 13/10* (2006.01)

(52) U.S. Cl.
CPC ..... *A47K 13/10* (2013.01)

(58) Field of Classification Search
USPC ..... 4/246.1–246.5
See application file for complete search history.

(56) References Cited

U.S. PATENT DOCUMENTS

| | | | | |
|---|---|---|---|---|
| 5,430,897 | A * | 7/1995 | Lavender | 4/246.1 |
| 5,774,904 | A * | 7/1998 | McWilliams | 4/246.2 |
| 6,067,667 | A * | 5/2000 | Suzuki | 4/246.1 |
| 6,694,536 | B1 * | 2/2004 | Haygreen | 4/246.1 |
| 2004/0107487 | A1 * | 6/2004 | Middleton | 4/246.1 |

* cited by examiner

*Primary Examiner* — Huyen Le
*Assistant Examiner* — Christine Skubinna
(74) *Attorney, Agent, or Firm* — Benjamin Aaron Adler

(57) ABSTRACT

An actuator includes first and second means for shifting, and those means are pistons, located within first and second components respectively, such that when the actuator is fitted over toilet lid each piston extends in substantially opposite directions. The first shifting means is activated upon the sensor detecting a predetermined condition, such as a hand passing over the sensor and shifts the position of the seat from the raised position such that the center of gravity is shifted past vertical, thereby causing the seat to shift to the lowered position. The second shifting means is triggered after a predetermined time, for example one second, to cause the toilet seat lid to be moved from the raised position such that the center of gravity is shifted past vertical, thereby causing the lid to shift to the lowered position to be substantially flush with the toilet seat.

16 Claims, 11 Drawing Sheets

ACTUATOR

FIELD OF THE INVENTION

The present invention relates to a hinged closure of a vessel, for example but not limited to a toilet seat and/or lid over a toilet bowl.

BACKGROUND TO THE INVENTION

It is often the case that toilet seats or lids are left in the open or "up" position. It might be that the previous user forgets to return the seat and lid to the closed or "down" position, they are in a hurry or do not wish to handle the toilet seat or lid, particularly if the toilet is a public toilet.

There are many reasons as to why individuals would prefer to have the toilet seat and lid kept in a closed position after use. When the lid is in a closed position, it prevents objects from falling into the toilet and is therefore more hygienic. For some individuals having the toilet seat and cover in a closed position is aesthetically appealing.

In addition to hygiene and appeal, it is a matter of convenience where a male and female are living in the same household and the male inadvertently fails to return the seat to a down position. However, the issue can become more serious where the household is shared with individuals with chronic or acute disabilities or physical limitations and require the toilet seat to be in the usable position.

In addition, it is preferable for parents of younger children and owners of household pets to keep the cover of a toilet seat down to prevent the children or pets from accessing or consuming the toilet water.

Currently the prior art provides for the use of an audible Sound when the: toilet seat has been raised and which continues to persist until the seat is lowered. Such a Solution creates an annoyance to the toilet user in addition to the annoyance caused to other individuals in a household particularly where the toilet is used frequently or during late hours.

The prior art also provides for devices requiring manual intervention by a user after their usage of the toilet which therefore does not alleviate the problem where the toilet seat and cover are left in an open position inadvertently. Further, these require the user to take an additional step, for example, of stepping onto a pedal link to a lever device or providing sufficient movement to activate sensors which are actions which must be remembered to be performed or require additional strength and energy than simply closing the toilet without such apparatuses.

In addition, the prior art lacks in the ability to allow for the dual ability to return the seat to the down position and to close the lid on a toilet.

It is therefore an object of the invention to overcome or at least ameliorate one or more problems of the prior art or to at least provide an effective alternative to the limited effectiveness of the prior art.

SUMMARY OF THE INVENTION

Some of the objects and advantages of the invention will now be set forth in the following description, while other objects and advantages of the invention may be obvious from the description, or may be learned through practice of the invention.

In accordance with the invention there is provided an actuator having a shifting means for offsetting a hinged means from a first position in which the centre of gravity of the hinged means is at or beyond vertical and a second position in which the hinged means is retained under the influence of gravity in the second position as a consequence of the centre of gravity being on the other side of vertical, whereby the actuator triggers the shifting means upon detecting a predetermined condition.

The predetermined condition can be a sensed condition or alternatively or in combination can be a timed period.

The actuator can include a first and second shifting means movable in opposing directions to allow two substantially co-hinged means to be lowered over each other whereby the actuator is attachable to one of said two substantially co-hinged means and the first shifting means deflects one co-hinged means away from the other and the second shifting means deflects co-hinged means having the mounted actuator away from an upright resting position.

According to one aspect, the present invention provides an actuator for causing a vessel to close, the vessel comprising a receptacle having a hinged closure positionable in an open position in which the receptacle is accessible with the centre of, gravity of the closure is to one side of vertical and the hinged closure is positionable in a closed position in which the closure is retained under the influence of gravity in a position to inhibit access to the receptacle as a consequence of the centre of gravity being on the other side of vertical, the actuator including: a body for connection to the closure; means for shifting the position of the closure from the open position such that the centre of gravity is shifted past vertical, thereby causing the closure to shift to the closed position; and a sensor for triggering the shifting means upon detecting a predetermined condition.

According to another aspect, the present invention provides an actuator for causing a toilet seat to be lowered close, the toilet seat hingably connected to a toilet bowl and positionable in a raised position in which the centre of gravity of the seat is to one side of vertical and the hinged closure is positionable in a lowered position in which the toilet is retained under the influence of gravity in a position to be substantially flush with the toilet bowl as a consequence of the centre of gravity being on the other side of vertical, the actuator including: a body for connection to a toilet seat lid; means for shifting the position of the seat from the raised position such that the centre of gravity is shifted past vertical, thereby causing the seat to shift to the lowered position; and a sensor for triggering the shifting means upon detecting a predetermined condition.

The actuator in another embodiment can include a body attachable to or integral with the cistern.

The actuator can include a body integral with the lid or toilet seat.

In one embodiment, actuator can include first and second shifting means with the first shifting means being immediately upon the senor detecting a predetermined condition, such as a hand passing over the sensor. The second shifting means may be triggered after a predetermined time, for example one second; to cause the toilet seat lid to be moved from the raised position such that the centre of gravity is shifted past vertical, thereby causing the seat to shift to the lowered position to be substantially flush with the toilet seat.

This embodiment provides that the toilet seat and lid are closed before the toilet is flushed minimizing splash and water vapor from leaving the toilet to assist in the prevention of spreading germs by having the toilet seat lowered without the user, having to touch it. Further, this embodiment reduces noise by returning the seat and lid at different times.

Preferably, the body is formed from first and second components which are connected by a hinge and is fitted to the periphery of the closure. More preferably, the actuator is fitted to the periphery of the closure opposite the hinge connecting the closure to the vessel. Advantageously, this arrangement requires the least amount of force exerted by the means for shifting the closure to cause the closure's centre of gravity to be shifted past vertical.

The means for shifting the position of the closure is preferably a piston which is moveable from a retracted position to an extended position. In a preferred embodiment, the piston is located in the first body component, and when triggered by the timer, the piston moves from the retracted position to the extended position to push against a fixture to cause movement of the closure or toilet seat and lid. The sensor can be a motion sensor, or alternatively a touch sensor.

In a particularly preferred embodiment, the actuator includes first and second means for shifting, and those means are pistons, located within first and second components respectively, such that when the actuator is fitted to the closure or toilet lid, each piston extends in substantially opposite directions. An advantage of this arrangement is that the actuator can be fitted to a toilet seat lid and simultaneously cause movement of the toilet seat and lid.

Alternatively, the first piston can be operated before the second piston, therefore lowering the toilet seat before the toilet lid. This arrangement avoids heavy banging of the toilet seat and lid, and reduces unnecessary noise.

The actuator is preferably powered by batteries, for example two AA batteries or a nine-volt battery which can be housed inside the first body components together with the necessary circuitry. More preferably the sensor is mounted on the second component such that when the actuator is fitted to the lid of a toilet seat, the sensor is substantially perpendicular to the lid of the toilet.

In a particularly preferred embodiment, the first component included two parts to allow easy access to replace the batteries. For example, the first component can include a fixture that is hingable mounted to the second component and a removable battery housing.

The actuator can also include means, in the form of a switch, for altering the amount of force provided by the pistons. Further, the switch can be used to turn off the second piston so that the toilet seat is closed but the lid remains open.

To preserve battery life, the actuator can be deactivated when in the lowered position, therefore the sensor will not operate in the lowered position. When the toilet seat is raised beyond a predetermined point, the actuator is activated and ready to be used.

According to another aspect, the present invention provides an actuator for causing a vessel to close, the vessel comprising a receptacle having a hinged closure positionable in an open position in which the receptacle is accessible with the centre of gravity of the closure is to one side of vertical and the hinged closure is positionable in a closed position in which the closure is retained under the influence of gravity in a position to inhibit access to the receptacle as a consequence of the centre of gravity being on the other side of vertical, the actuator including: a body for connection to the closure; means for shifting the position of the closure from the open position such that the centre of gravity is shifted past vertical, thereby causing the closure to shift to the closed position; a timer for triggering the shifting means after a predetermined period expires; and a sensor for activating the timer upon detecting a predetermined condition Advantageously the sensor can be located such that the timer is activated when motion is detected. The timer can be set to any desirable time, but preferably is set for between 2 and 5 minutes, and more preferably for two minutes. Therefore, the closure is automatically lowered.

According to another aspect, the present invention provides an actuator for causing a toilet seat to be lowered, the toilet seat hingably connected to a toilet bowl and being 'positionable in a raised Position in which the centre of gravity of the toilet seat is to one side of vertical and positionable to a lowered position in which the toilet seat is retained under the influence of gravity in a position to be substantially flush with the toilet bowl as a consequence of the centre of gravity being on the other side of vertical, the actuator including: a body for connection to a toilet seat lid; means for shifting the position of the toilet seat from the open position such that the centre of gravity is shifted past vertical thereby causing the toilet to shift to the closed position the necessary circuitry More preferably, the sensor is mounted on the second component such that when the actuator is fitted to the lid of a toilet seat, the sensor is substantially perpendicular to the lid of the toilet.

In a particularly preferred embodiment the first component included two parts to allow easy access to replace the batteries. For example, the first component can include a fixture that is hingable mounted to the second component and a removable battery housing.

The actuator can also include means, in the form of a switch, for altering the amount of force provided by the pistons. Further, the switch can be used to turn off the second piston so that the toilet seat is closed but the lid remains open.

To preserve battery life, the actuator can be deactivated when in the lowered position, therefore the sensor will not operate in the lowered position. When the toilet seat is raised beyond a predetermined point, the actuator is activated and ready to be used.

The actuator can also include means, in the form of a switch, for altering the amount of force provided by the pistons. Further, the switch can be used to turn off the second piston so that the toilet seat is closed but the lid remains open.

To preserve battery life, the actuator can be deactivated when in the lowered position, therefore the sensor will not operate in the lowered position. When the toilet seat is raised beyond a predetermined point, the actuator is activated and ready to be used.

According to another aspect, the present invention provides an actuator for causing a vessel to close, the vessel comprising a receptacle having a hinged closure positionable in an open position in which the receptacle is accessible with the centre of gravity of the closure is to one side of vertical and the hinged closure is positionable in a closed position in which the closure is retained under the influence of gravity in a position to inhibit access to the receptacle as a consequence of the centre of gravity being on the other side of vertical, the actuator including: a body for connection to the closure; means for shifting the position of the closure from the open position such that the centre of gravity is shifted past vertical, thereby causing the closure to shift to the closed position; a timer for triggering the shifting means after a predetermined period expires; and a sensor for activating the timer upon detecting a predetermined condition.

Advantageously, the sensor can be located such that the timer is activated when motion is detected. The timer can be set to any desirable time, but preferably is set for between 2 and 5 minutes, and more preferably for two minutes. Therefore, the closure is automatically lowered.

According to another aspect, the present invention provides an actuator for causing a toilet seat to be lowered, the toilet seat hingably connected to a toilet bowl and being positionable in a raised position in which the centre of gravity of the toilet seat is to one side of vertical and positionable to a lowered position in which the toilet seat is retained under the influence of gravity in a position to be substantially flush with the toilet bowl as a consequence of the centre of gravity being on the other side of vertical the actuator including: a body for connection to a toilet seat lid; means for shifting the position of the toilet seat from the open position such that the centre of gravity is shifted past vertical thereby causing the toilet to shift to the closed position a timer for triggering the shifting means after a predetermined period expires; and a sensor for activating the timer upon detecting a predetermined condition.

Advantageously, the sensor can be located such that the timer is activated when motion is detected, for example a hand passing over the sensor. The timer can be set to any desirable time, but preferably is set for between 2 and 5 minutes, and more preferably for two minutes. Therefore, the lid and seat are automatically lowered when the user finishes using the toilet without anyone having to touch the seat or lid.

Preferably, the body is formed from first and second components which are connected by a hinge and is fitted to the periphery of the closure. More preferably, the actuator is fitted to the periphery of the closure opposite the hinge connecting the closure to the vessel. Advantageously, this arrangement requires the least amount of force exerted by the means for shifting the closure to cause the closure's centre of gravity to be shifted past vertical.

The means for shifting the position of the closure is preferably a piston which is moveable from a retracted position to an extended position. In a preferred embodiment, the piston is located in the first body component, and when triggered by the timer, the piston moves from the retracted position to the extended position to push against a fixture to cause movement of the closure or toilet seat and lid. The sensor can be a motion sensor, or alternatively a touch sensor.

In a particularly preferred embodiment, the actuator includes first and second means for shifting, and those means are pistons, located within first and second components respectively, such that when the actuator is fitted to the closure or toilet lid; each piston extends in substantially opposite directions. An advantage of this arrangement is that the actuator can be fitted to a toilet seat lid and simultaneously cause movement of the toilet seat and lid.

Alternatively, the first piston can be operated before the second piston, therefore lowering the toilet seat before the toilet lid. This arrangement avoids heavy banging of the toilet seat and lid, and reduces unnecessary noise.

The actuator is preferably powered by batteries, for example two AA batteries or a nine-volt battery which can be housed inside the first body components together with the necessary circuitry. More preferably, the sensor is mounted on the second component such that when the actuator is fitted to the lid of a toilet seat, the sensor is substantially perpendicular to the lid of the toilet.

In a particularly preferred embodiment, the first component included two parts to allow easy access to replace the batteries. For example, the first component can include a fixture that is hingable mounted to the second component and a removable battery housing.

The actuator can also include means, in the form of a switch, for altering the amount of force provided by the pistons. Further, the switch can be used to turn off the second piston so that the toilet seat is closed but the lid remains open.

To preserve battery life, the actuator can be deactivated when in the lowered position, therefore the sensor will not operate in the lowered position. When the toilet seat is raised beyond a predetermined point, the actuator is activated and ready to be used.

The invention also provides a method of controlling a hinged element between an upright position and a lowered position, including the steps of: providing a means for maintaining a hinged element in a substantially upright position; providing an actuator having means for shifting the position of the hinged element from the upright position; providing an initiation means such as a sensor, timer or switch for initiating the actuator; the initiation means receiving an initiation signal and instigating the actuator to provide a partial movement of the hinged element between an upright position and a lowered position sufficient to overcome the means for maintaining a hinged element in an upright position and allowing gravity to complete the movement of the hinged element between an upright position and a lowered position.

The means for maintaining a hinged element in a substantially upright position Position can merely be a leaning position on opposed side of vertical to the side of the required movement of the hinged element between an upright position and a lowered position.

However the means for maintaining a hinged element in a substantially upright position can be a frictional magnetic, or other hold and the means for shifting the position of the hinged element from the upright position having sufficient force to overcome the frictional, magnetic, or other hold and allowing gravity to complete the movement of the hinged element between an upright position and a lowered position.

The gravity movement of the hinged element between an upright position and a lowered position can include a controlling element such as spring, hydraulic, frictional or resilience to control or modify the effect of the gravity movement of the hinged element between an upright position and a lowered position.

It can be seen that the present invention in one form provides a device to return the seat to the down" position or close the lid on a toilet after the toilet has been used in a manner which is simple, convenient and does not impede on the aesthetics of the bathroom.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention (s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

A preferred embodiment of the invention will now be described, by way of example only, with reference to the accompanying drawings, in which.

DESCRIPTION OF A PREFERRED EMBODIMENT OF THE INVENTION

Figure 1:
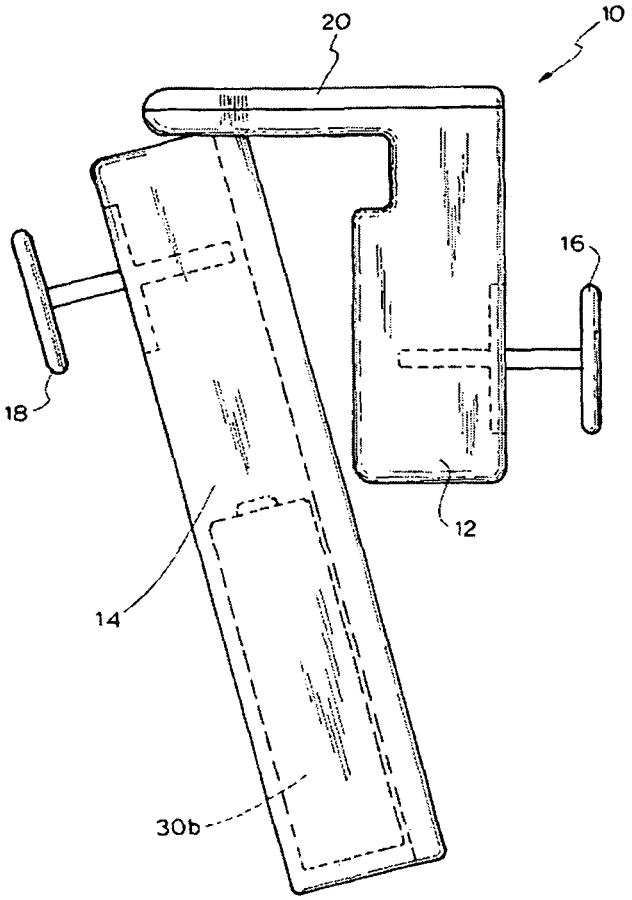
FIG. 1 is a side view of an actuator with a shifting means in the form of a piston according to the first embodiment of the present invention.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

For the purposes of this document two or more items are "mechanically associated" by bringing them together or into relationship with each other in any number of ways including a direct or indirect physical connection that may be releasable (snaps, rivets, screws, bolts, etc.) and/or movable (rotating, pivoting, oscillating, etc.) Similarly, two or more items are "electrically associated" by bringing them together or into relationship with each other in any number of ways including: (a) a direct, indirect, wireless, or inductive communication connection, and (b) a direct/indirect or inductive power connection. Additionally, while the drawings may illustrate various electronic components of a system connected by a single line, it will be appreciated that such lines may represent one or more signal paths, power connections, electrical connections and/or cables as required by the embodiment of interest.

While this section of the specification may contain headers, such headers are simply place markers and do not form a part of the specification and are not to be used in the construction of the specification.

FIG. 1 shows an actuator 10 in accordance with a preferred embodiment of the IS present invention The actuator 10 causes a vessel, in the form of toilet 100 to close, the vessel 100 comprising a receptacle, toilet bowl 102, having a hinged closure toilet lid 106, positionable in an open position in which the receptacle 102 is accessible with the centre of gravity of the closure is to one side of vertical and the hinged closure 106 is positionable in a closed position in which the closure 106 is retained under the influence of gravity in a position to inhibit access to the receptacle 102 as a consequence of the centre of gravity being on the other side of vertical.

Figure 2:
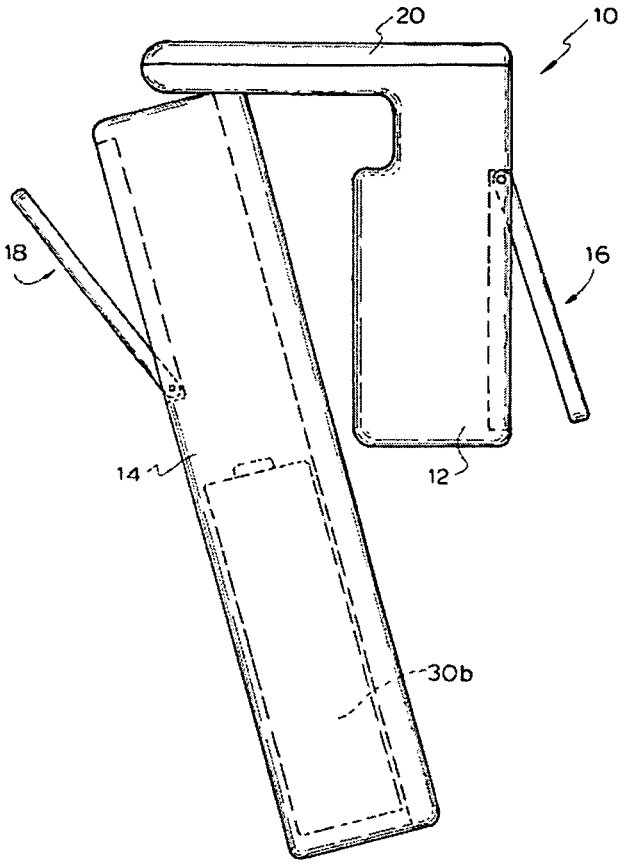
FIG. 2 is a side view of an actuator with a shifting means in the form of a lever according to the first embodiment of the present invention.

The actuator 10 includes body in the form of first component 12 and second component 14. The actuator further includes a shifting means for shifting the position of the closure from the open position to the closed position such that the centre of gravity is shifted past vertical, thereby causing the closure to shift to the closed position. Such a shifting means can be in the form of pistons, as seen in FIG. 1 as 16 and 18 and in the form of lever arms as seen in FIG. 2 as 16 and 18 or a combination thereof. It is however envisaged that the actuator can comprise of other shifting means such as a knob or switch or other alternate mechanism allowing the hinged closure to move past the centre of gravity.

In the preferred embodiment, the invention provides for two shifting means to allow for the closure of the vessel and the, closure of an intermediate structure such as a toilet: seat. The shifting means is to, be moveable from a retracted position to an extended position when triggered by the activations means.

Figure 10:
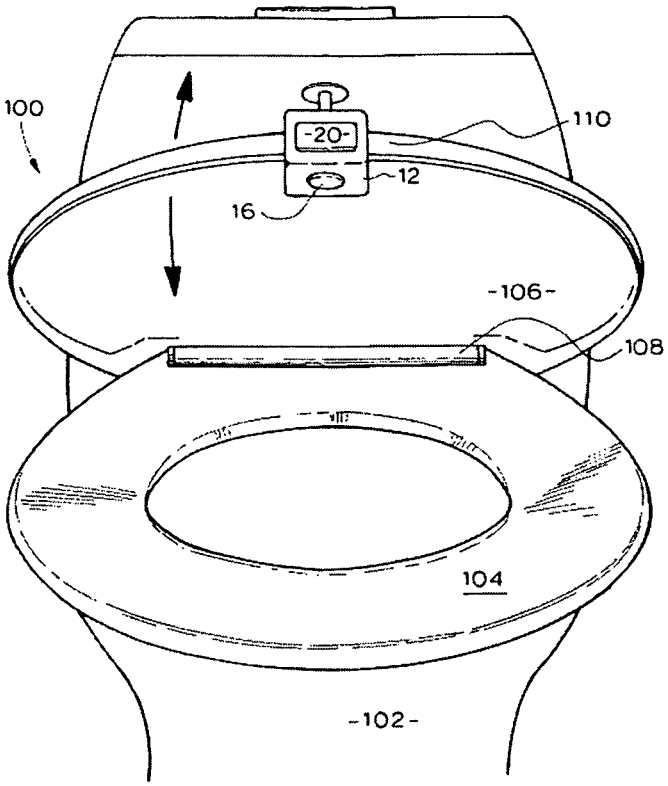
FIG. 10 is a top perspective view of an actuator in use in which the shifting means is in the protruded state thereby shifting the position of the hinged element, in the form of a toilet seat cover, from the upright position to the down position in accordance with an embodiment of the invention
Figure 11:
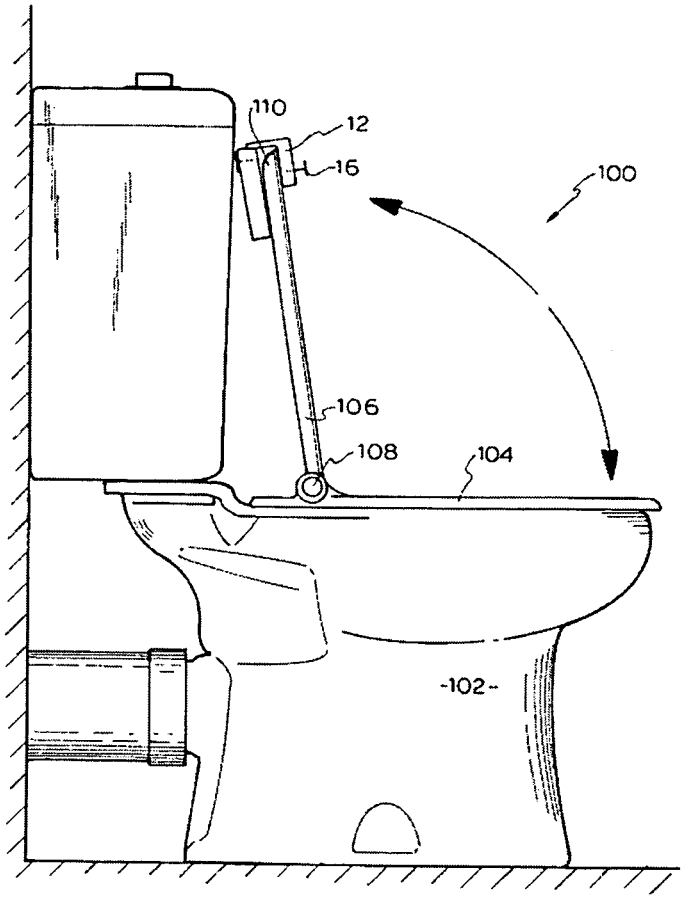
FIG. 11 is a side view of the actuator in FIG. 10 in which the shifting means on the first component is in the protruded state thereby shifting the position of the hinged element, in the form of a toilet seat, from the upright position to the down position in accordance with an embodiment of the invention.

In reference to the first embodiment of the invention as seen in FIGS. 1 and 2, the first piston 16 appears on the first component 12 and the second piston 18 appears on the second component 14. As seen in FIGS. 10 and 11, the first piston 16, when in the protruded state, allows for the toilet seat to make contact with the face of the toilet seat and force it to move past the centre of gravity. The second piston 18, when in the protruded state makes contact with the cistern to allow the cover of the toilet to move past the centre of gravity.

It is however envisaged that the actuator can include a single shifting means to 10 provide the single use of closing the vessel or moving the toilet seat to a down position, It is though noted that a single shifting means on the second component will allow closure of the vessel and toilet seat simultaneously. It is further noted that the positioning of the actuator 10 on different vessels or hinged closures will dictate and alter the function of the pistons 16 and 18, such as a toilet seat, will require the second piston 18 to form a different function and, in the protruded state, make contact with the toilet cover to push the toilet seat past the centre of gravity.

The actuator provides a first and second activation means of activating the shifting means. The first activation-means provides for a sensor in the form of a microchip 20, for activating the timer upon determining a predetermined condition, such as the waving of a hand or the sensing of a user stepping forward to push the flush button. The microchip 20 also includes the timer. The second activation means can be triggered by the sensor detecting a timer for triggering the shifting means after a predetermined period expires. Such an activation means allows for the toilet seat and lid to be in the closed position before the flushing action occurs in order to prevent splash and water vapors and the spreading of germs by eliminating the need of the user to touch the toilet seat or cover.

The actuator is approximately 50-55 mm wide, 60-65 mm high and 20-25 mm thick 30 with 20 mm retractable pistons 16 and 18. The touch pad can vary in size, but is approximately 45 mm wide×55 mm high time delay touch pad. It will be appreciated that the actuator 10, when compared to the size of a toilet 100, is relatively small and unobtrusive. The actuator can further include recesses and apertures to assist in the placement of the actuator in a position in which to minimize inconvenience.

The actuator 10 is powered by batteries either double A batteries 30*a* and 30*b*, or a single 9 volt battery 30*c*. It is however envisaged that alternate power sources may be provided such as rechargeable batteries, where a separate adaptor is provided and attached via a cable to an aperture in the second component 14 to receive the cable and provide a charging means.

The batteries are housed within the second component 14 which forms a removable portion of the actuator 10. The second component 14 is slideably mounted on arm 22 on the first component 12 as the first component 12 provides for a first receiving mean 23. As the receiving means 23 is complementary to the gripping means 24 on the second component 14, the gripping means 24 can be slideably received by the receiving means 23.

The gripping means 24 and the receiving means 23 can be in various forms such as a zip lock effect, Velcro or snap fit effect. However, it is envisaged than any complementary mechanism can be utilized in order to allow the second component to be removed and attached as desired.

Figure 3:
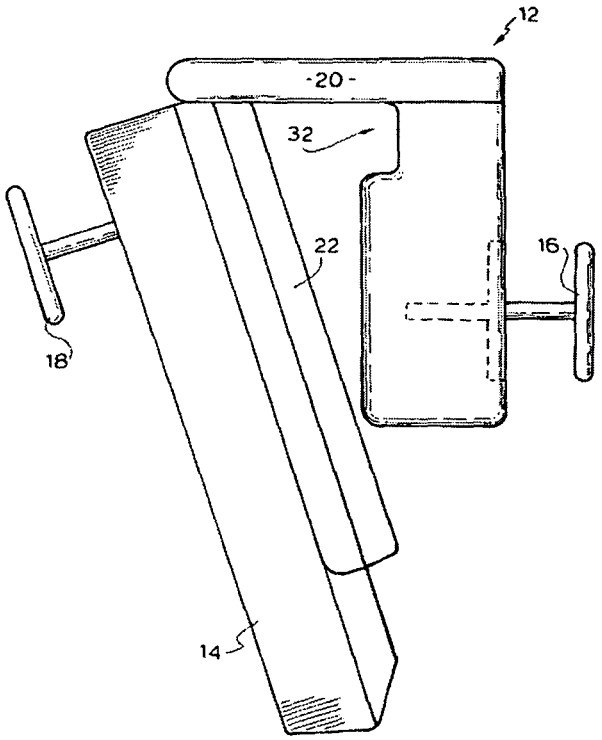
FIG. 3 is a side view of an actuator with a shifting means in the form of a piston and a second component as a removable portion according to a second embodiment of the invention.
Figure 4:
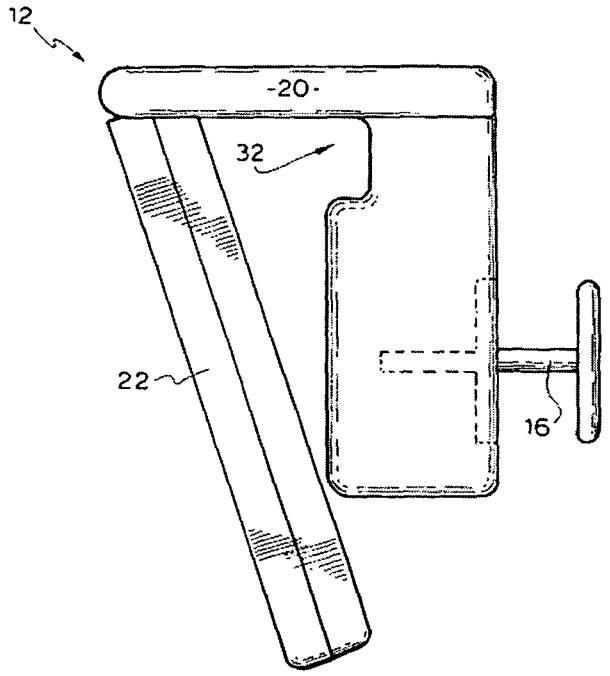
FIG. 4 is a side view of the first component of the actuator in FIG. 3 with a shifting means in the form of a piston and an arm in accordance with second embodiment of the invention.
Figure 5:
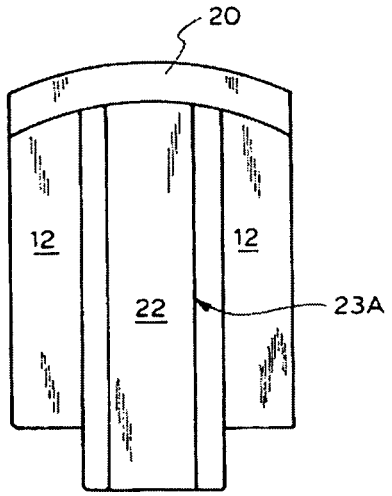
FIG. 5 is a rear view of the first component of the actuator in FIGS. 3 and 4.

The invention further provides for two embodiments of the invention. FIGS. 1 and 2 illustrate one embodiment which does not provide for a mounted arm 22 as the second component 14 is permanently attached to first component 12. In contrast the second embodiment as illustrate in FIGS. 3 to 5, provides for the second component 14 as a removable portion whereby the arm 22 forms a hinge between the first component 12 and the second component 14.

The valley 32 in the first component 14 of actuator 10 is adapted to receive a lip 110 25 of the toilet seat lid 106. The hingably connected arm 22 allows for lips of varying thicknesses to be received therein. The actuator 10 can be mounted at any peripheral point of the toilet seat lid 106 and the actuator 10 allows ease of attaching and detaching the device. However, as shown in FIGS. 10 and 11, the actuator 10 will operate most effectively if positioned substantially opposite the main toilet seat hinge 108. It is envisaged however that the actuator can be fixed permanently to the toilet lid or seat as a permanent fixture or manufactured as part of the toilet seat or cover. This would more readily allow for the toilet seat or cover to seat balanced in the closed position.

Figure 6:
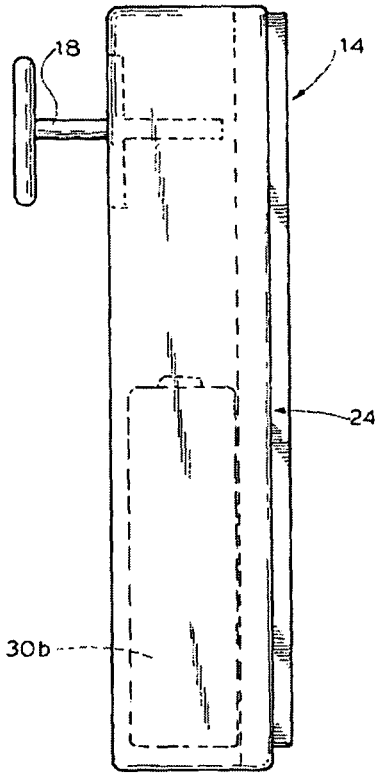
FIG. 6 is a side view of the second component of the actuator in FIG. 3 with a shifting means in the form of a piston and a gripping means in accordance with the second embodiment of the invention.
Figure 7:
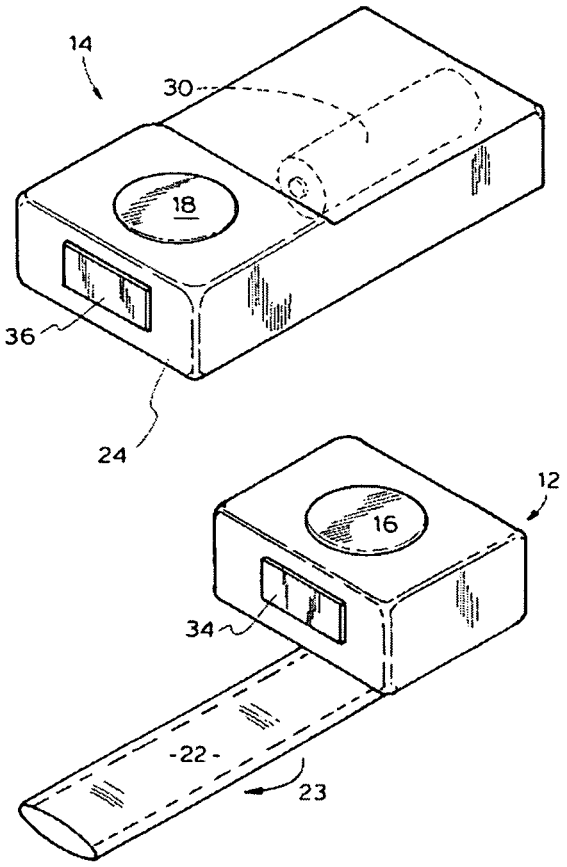
FIG. 7 is a top perspective view of an actuator in accordance with the second embodiment of the invention.
Figure 8:
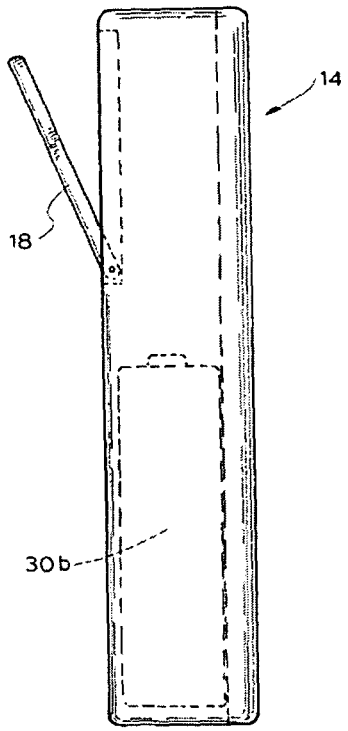
FIG. 8 is a side view of the second component of the actuator in FIG. 3 with the gripping means and a shifting means in the form of a lever.

The actuator 10 is ready for use when the toilet seat 106 or both toilet seat 104 and lid 106 are lifted so that the toilet 100 can be Used When the seat 104 is lifted, the microchip 2*ci* is engaged when the toilet seat 104 passes through a predetermined angle, for example 800. When the toilet 100 is finished being used, the user waves their hand above the microchip 20 to trigger the piston 16 and one second later trigger piston 18 to move from their retracted position (shown in dashed lines in FIGS. 5 and 6) to their extended position. Piston 18 extends to contact the water tank of the toilet (not shown) to push the lid 106 away from the tank, while piston 16 extends from the first component to the toilet seat 104 away from the lid 106 causing both the lid 106 and the seat 104 past vertical to close. The lid 106 and seat 104 are not in substantially horizontal positions and user can now flush the toilet without having to have handled either the seat 104 or lid 106.

The actuator 10 automatically disengages and is inoperable when the lid 106 or seat 104 is placed in a horizontal position as the microchip switches off the actuator 10 to conserve power and prevent it from triggering whilst the toilet seat 104 or lid 106 is in a closed position.

The first component 12 of the actuator 10 includes a switch 34 for varying the amount of force applied by piston 16 to the toilet seat 104 to cause it to move from the raised to the lowered position. Similarly, the second component 14 of actuator 10 includes a switch 36 for increasing or decreasing the amount of force applied by piston 18 to toilet lid 106. Switch 36 can also turn off piston 18 such that the toilet lid 106 remains raised by the seat 104 is lowered.

Figure 9:
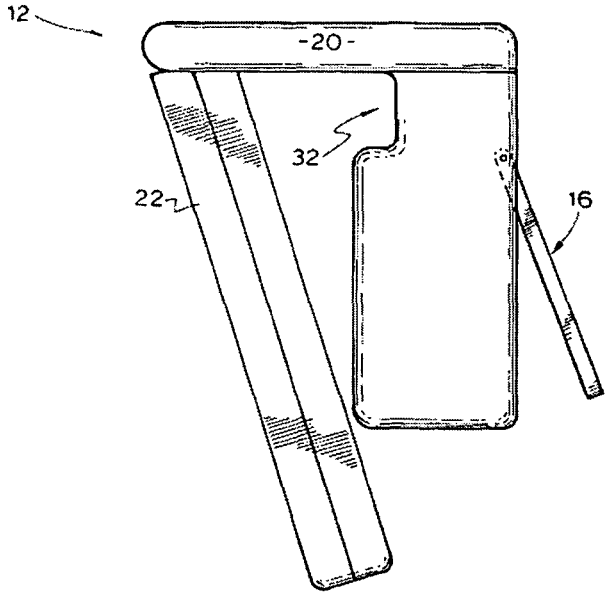
FIG. 9 is a side view of the first component of an actuator with a shifting means in the form of a lever and an arm in accordance with the second embodiment of the invention.

FIG. 9 shows an alternative embodiment of the present invention in which actuator 210 includes a sensor and timer in the form of microchip 220. The actuator 210 is mounted on the toilet lid in the same manner of actuator 10, but operates in the following manner: when toilet seat 104 is raised, microchip 220 makes contact with the lid 106. The microchip 220 then begins counting down a predetermined time, for example 2 minutes, at the end of which piston 216 which be triggered to lower the toilet seat 104.

The actuator 10 may be used in conjunction with padding in the form of soft leather or self stick pads to reduce noise and shock resulting from the impact from the closing lid.

To further allow the actuator 10 to be fitted appropriately onto a toilet seat cover a stiff plastic section can be placed into the inside of the toilet seat cover in the form of a 'T.' The actuator is therefore placed onto the 'T' form of the toilet seat allowing for the deflector to slide into it thereby providing for the actuator to attach directly onto the lid so as it does not slip or move.

It will be appreciated that the actuator 10 can be manufactured according to the 5 desired color and/or pattern of the user to coincide with the color of the toilet, or the general decor of the bathroom. The actuator can be form from injected plastic that is similar in material to that of a toilet seat plastic.

As shown in operation in FIGS. 10 and 11, an actuator includes first and second 10 means 16, 18 for shifting, and those means are pistons, located within first and second components respectively, such that when the actuator is fitted over toilet lid 106 each piston 16, 18 extends in substantially opposite directions. The first shifting means 16 is activated upon the sensor detecting a predetermined condition, such as a hand passing over the sensor and shifts the position of the seat 104 from the 15 raised position such that the centre of gravity is shifted past vertical, thereby causing the seat to shift to the lowered position. The second shifting means 18 is triggered after a predetermined time, for example one second, to cause the toilet seat lid 106 to be moved from the raised position such that the centre of gravity is shifted past vertical, thereby causing the lid 106 to shift to the lowered position to be substantially flush with the toilet seat 104.

Many modifications may be made to the preferred embodiment of the present invention as described above without departing from the spirit and scope of the present invention as defined in the following claims. For example, it ~S envisaged that the invention may be located to close lids of rubbish bins and to close any other vessel having a receptacle and a hinged lid by utilizing the actuator described above or an alternative embodiment thereof. However it is particularly suited to the double co-hinged structure of a toilet seat and lid.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

The invention claimed is:

1. An actuator for causing a toilet lid and/or seat to lower relative to a toilet bowl wherein the toilet lid and seat are hingedly connected to the toilet bowl and are lowered separately or together from an open position in which the toilet bowl is accessible with the center of gravity of the toilet lid and/or toilet seat to one side of vertical and the toilet lid and/or toilet seat being positionable in a closed position in which the toilet lid and/or toilet seat is/are retained under the influence of gravity in a position to inhibit access to the toilet bowl as a consequence of the center of gravity being on the other side of vertical, the actuator including:

a. a body comprising first and second components whereby the first and second components are connected by a hinge, and the first and second components being biased towards a clamping condition so that in use the first and second components engage top and underneath surfaces of the toilet lid to allow secure mounting of the body to a rim portion of the toilet lid;

b. the body including a shifting means on at least one of the first and second components the shifting means being movable between a stored and active condition for shifting the position of the toilet lid and/or toilet seat from the open position such that the center of gravity is shifted past vertical, thereby causing the toilet lid and/or toilet seat to shift to the closed position;

c. the body including a timer for triggering the shifting means from a stored condition to the active condition after a predetermined period expires; and d. the body including a sensor for activating the timer upon detecting a predetermined condition.

2. An actuator according to claim 1 wherein the predetermined condition is an independently sensed condition.

3. An actuator according to claim 1 wherein the predetermined condition is a predefined timed period.

4. A method of controlling a toilet lid and toilet seat between an upright position and a lowered position relative to a toilet bowl including the steps of:

a. providing a means for maintaining a toilet lid and toilet seat in a substantially upright position;

b. providing the actuator according to claim 1;

c. providing an initiation means for initiating the actuator;

d. the initiation means receiving an initiation signal and instigating the actuator e. the actuator upon receipt of the initiation signal causing the shifting means to provide a partial movement of the toilet lid and/or toilet seat between an upright position and a lowered position sufficient to overcome the means for maintaining a toilet lid and/or toilet seat in an upright position and allowing gravity to complete the movement of the toilet lid and/or toilet seat between an upright position and a lowered position.

5. A method of controlling a toilet lid and/or toilet seat between an upright position and a lowered position comprising: providing the actuator according to claim 1 wherein the actuator comprises a first and second shifting means on the first and second components of the body respectively for shifting in opposing directions wherein the first and second shifting means movable in opposing directions such that the first shifting means is activated upon the sensor detecting a predetermined condition, including a hand passing over the sensor and shifts the position of the toilet seat from the raised position such that the center of gravity is shifted past vertical, thereby causing the seat to shift to the lowered position, and wherein the second shifting means is triggered after a predetermined time to cause the toilet lid to be moved from the raised position such that the center of gravity is shifted past vertical, thereby causing the toilet lid to shift to the lowered position to be substantially flush with the toilet seat.

6. An actuator according to claim 5 wherein the actuator includes a first and second shifting means movable in opposing directions to allow two substantially co-hinged means to be lowered over each other whereby the actuator is attachable to one of said two substantially co-hinged means and the first shifting means deflects one co-hinged means away from the other and the second shifting means deflects co-hinged means having the mounted actuator away from an upright resting position.

7. An actuator for closing a vessel, the vessel having an opening with a hinged closure positionable between an open position in which the center of gravity of the closure is at or beyond vertical and a closed position in which the closure is retained under the influence of gravity in a position to close the vessel as a consequence of the center of gravity being on the other side of vertical, the actuator including:

a. a body for connection to the closure that is formed from first and second components whereby the first and second components are connected by a hinge and is fitted to the periphery of the closure;

b. means for shifting the position of the closure from the open position such that the center of gravity is shifted past vertical, thereby causing the closure to shift to the closed position; and c. a sensor for triggering the shifting means upon detecting a predetermined condition.

8. An actuator for closing a vessel, wherein the vessel is a toilet bowl and the hinged closure is a toilet seat and/or lid which is hingeably connected to the toilet bowl and positionable in a raised position in which the center of gravity of the seat/lid is to one side of vertical and the hinged closure is positionable in a lowered position in which the toilet is retained under the influence of gravity in a position to be substantially flush with the toilet bowl as a consequence of the center of gravity being on the other side of vertical, the actuator including:

a. a body for detachable connection to a toilet seat/lid that is formed from first and second components whereby the first and second components are connected by a hinge;

b. means for shifting the position of the seat from the raised position such that the center of gravity is shifted past vertical, thereby causing the seat/lid to shift to the lowered position; and c. an independent sensor for triggering the shifting means upon independently detecting a predetermined condition, wherein the actuator can be readily removably attached to the toilet seat to provide an operative automatic closing mechanism.

9. An actuator according to claim 8 wherein the shifting means is activated upon the sensor detecting a predetermined condition, including a hand passing over the sensor.

10. An actuator according to claim 8 wherein the shifting means is triggered after a predetermined time, to cause the toilet seat lid to be moved from the raised position such that the center of gravity is shifted past vertical, thereby causing the seat to shift to the lowered position to be substantially flush with the toilet seat.

11. An actuator according to claim 8, the actuator including a first and second shifting means movable in opposing directions and attachable to a lid of a toilet seat, wherein the first shifting means is activated upon the sensor detecting a predetermined condition, including a hand passing over the sensor and shifts the position of the seat from the raised position such that the center of gravity is shifted past vertical, thereby causing the seat to shift to the lowered position, and wherein the second shifting means is triggered after a predetermined time to cause the toilet seat lid to be moved from the raised position such that the center of gravity is shifted past vertical, thereby causing the seat to shift to the lowered position to be substantially flush with the toilet seat.

12. An actuator according to claim 8 wherein the actuator is able to be fitted to the periphery of the closure opposite the hinge connecting the closure to the vessel.

13. An actuator according to claim 8 whereby the actuator includes first and second means for shifting, and those means are pistons, located within first and second components respectively, such that when the actuator is fitted to the closure or toilet lid, each piston extends in substantially opposite directions.

14. An actuator according to claim 13 whereby the first and or second piston can be moved laterally relative to each other so as to align with toilet lid on one side and the cistern or wall on the other side and thereby allow opposing directional operation.

15. An actuator according to claim 14 whereby the first piston can be operated before the second piston, therefore lowering the toilet seat before the toilet lid.

16. An actuator according to claim 15 including:

a. a timer for triggering the shifting means after a predetermined period expires; and b. a sensor for activating the timer upon detecting a predetermined condition.

* * * * *